US005832540A

United States Patent [19]

Knight

[11] Patent Number: 5,832,540

[45] Date of Patent: Nov. 10, 1998

[54] POCKET ASSEMBLY FOR USE ON CLOTHES

[76] Inventor: Joel T. Knight, 104 Woodfield Dr., Warner Robins, Ga. 31088

[21] Appl. No.: 803,951

[22] Filed: Feb. 21, 1997

[51] Int. Cl.[6] ..... A41D 27/20; A41D 27/08

[52] U.S. Cl. ..... 2/247; 2/253; 2/243.1; 2/244

[58] Field of Search ..... 2/69, 69.5, 75, 2/80, 49.1, 105, 106, 115, 244, 247, 243, 253, 248, 249, 250, 251, 252, 279, 243.1

[56] References Cited

U.S. PATENT DOCUMENTS

| | | | |
|---|---|---|---|
| 1,480,538 | 1/1924 | Parkes | 2/244 |
| 2,511,242 | 6/1950 | Brown | 2/279 |
| 2,986,743 | 6/1961 | Eilen | 2/247 |
| 4,266,300 | 5/1981 | Partridge | 2/247 |
| 4,924,613 | 5/1990 | Levin | 2/247 |
| 5,073,987 | 12/1991 | Crosier | 2/247 |

FOREIGN PATENT DOCUMENTS

| | | | |
|---|---|---|---|
| 2030844 | 4/1980 | United Kingdom | 2/247 |

*Primary Examiner*—Jeanette E. Chapman

[57] ABSTRACT

A pocket assembly for clothing having a fashion pocket (1), a functional pocket (5) and an insert (6). The fashion pocket (1) has a window opening (3) sealed with embroidery (4) which provides for the display of insert (6). Insert (6) is located between fashion pocket (1) and functional pocket (5) and is removable and reversible to alter the appearance of clothing item (12). Functional pocket (5) is located between fashion pocket (1) and clothing item (12). Functional pocket (5) is visible through window opening (3) when insert (6) is not installed.

7 Claims, 1 Drawing Sheet

POCKET ASSEMBLY FOR USE ON CLOTHES

BACKGROUND—FIELD OF INVENTION

This invention relates to clothing pocket assemblies. Specifically to such clothing pocket assemblies which are used to display objects.

BACKGROUND—DESCRIPTION OF PRIOR ART

Previous inventors have developed pocket designs which allow for the display of objects through window openings (openings) in pockets. These designs have consisted of two general methods.

The most common method has been to use transparent plastic covering as an integral part of the opening. An object placed in the pocket is then visible through the transparent plastic. U.S. Pat. No. 2,986,743 to Eilen (1958) uses transparent plastic as the center part of the pocket with fabric forming the perimeter of the pocket. U.S. Pat. No. 3,055,133 to Anderson (1960) uses transparent plastic as the entire pocket. The use of plastic on primary clothing (shirts, pants and hats) is not suitable for casual activewear. Plastic is easy to tear, puncture or crease which makes the end item of clothing unsuitable for moderate to high activity uses. Also, the use of plastic in either manner renders the clothing item to which it is attached difficult to maintain. The ironing or mechanical washing or drying of the clothing item could easily lead to damage of the plastic. The only viable alternative to self maintenance is commercial dry cleaning which can be expensive because of the care required. Primary clothing using plastics have never been widely accepted by the public.

Another method of displaying an object in a pocket is to use an uncovered opening. U.S. Pat. No. 2,671,902 to Grue (1954) uses this method. While avoiding the use of plastic, this method requires that the opening be sealed by hemming. Hemming to seal the opening brings about a substantial limitation to the shapes of the openings that can be successfully used. That limitation directly transfers to limiting both the conditions and frequency in which the clothing item may be used. Hemming at its best use requires that the opening be formed from all straight lines. Even under this condition, the unreinforced area of the opening still exist in each corner where the lines intersect. Unraveling of thread along the unreinforced edges of fabric is imminent. Attempts to hem openings which contain curved lines would only create a greater amount of unreinforced area around the opening. Hemming in this manner increases the susceptibility and rate of fabric unraveling. Hemming limits the end item of clothing to formal and low activity uses to avoid stressing the unreinforced areas of the opening. As with the use of plastic, dry cleaning costs would be necessary to avoid garment degradation while cleaning.

Inability to solve maintenance and durability problems have prevented widespread use of pockets with openings. To date, the use has emphasized the object being displayed in formal or low activity settings. Using pockets with openings as a fashion enhancement for often worn casual activewear has previously been impractical.

OBJECTS AND ADVANTAGES

Accordingly, several objects and advantages of my invention are:

(a) to provide a pocket assembly which adds fashion enhancement capabilities to often worn casual activewear.

(b) to provide a pocket assembly which has a lightweight reversible insert which quickly alters the appearance of casual activewear without having to remove the garment.

(c) to provide a pocket assembly whose window opening is completely sealed with embroidery for both fashion enhancement and durability.

(d) to provide a pocket assembly whose embroidery shall be of sufficient width that use of a contrasting color from the fashion pocket will increase opportunities for fashion coordination.

(e) to provide a pocket assembly whose shapes of window openings have numerous possibilities due to the capabilities of computerized embroidery machines.

(f) to provide a pocket assembly which alleviates the need for commercial cleaning, drying or pressing in addition to that required for the clothing item itself.

(g) to provide a pocket assembly which has a functional pocket to maintain the object retention capabilities of conventional clothing pockets.

Further objects and advantages are to provide a pocket assembly which produces a dramatic fashion effect when multiple pocket assemblies are used on one clothing item, which saves the consumer money since one clothing item can be worn with a greater number of clothing accessories, which caters to individual fashion tastes due to the larger number of fabric patterns available for pockets and inserts, and which uses a different fabric design for the functional pocket to allow the clothing item to be used even if the insert is lost or intentionally removed. Still further objects and advantages will become apparent from a consideration of the ensuing description and drawings.

DRAWING FIGURES

REFERENCE NUMERALS IN DRAWINGS

Figure 1A:
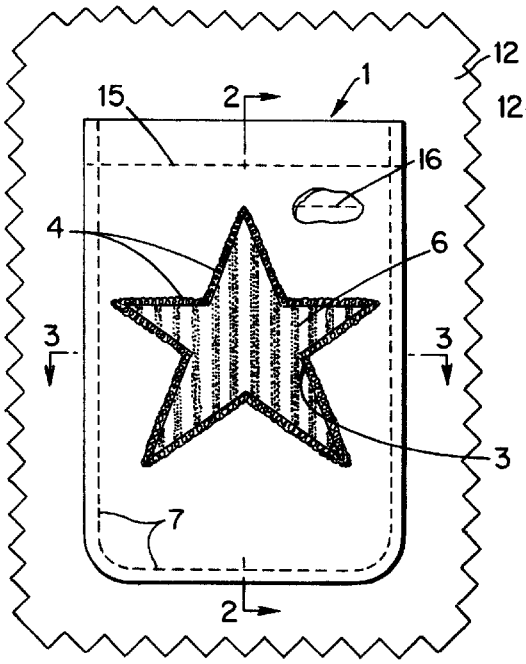
FIGS. 1A and 1B show various aspects of a pocket assembly.

1. fashion pocket
2. fusible bond
3. window opening
4. embroidery
5. functional pocket
6. insert
7. pocket assembly attachment stitching
8. insert side 1
9. insert side 2
10. insert stiffener
11. insert assembly stitching
12. clothing item (ref.)
13. fashion pocket finished top
14. functional pocket finished top
15. fashion pocket finished top stitching
16. functional pocket finished top stitching

SUMMARY

In accordance with the present invention a pocket assembly comprises a fashion pocket with a window opening, a functional pocket for object retention and a reversible insert.

Description—FIGS. 1 to 4

Figure 1B:
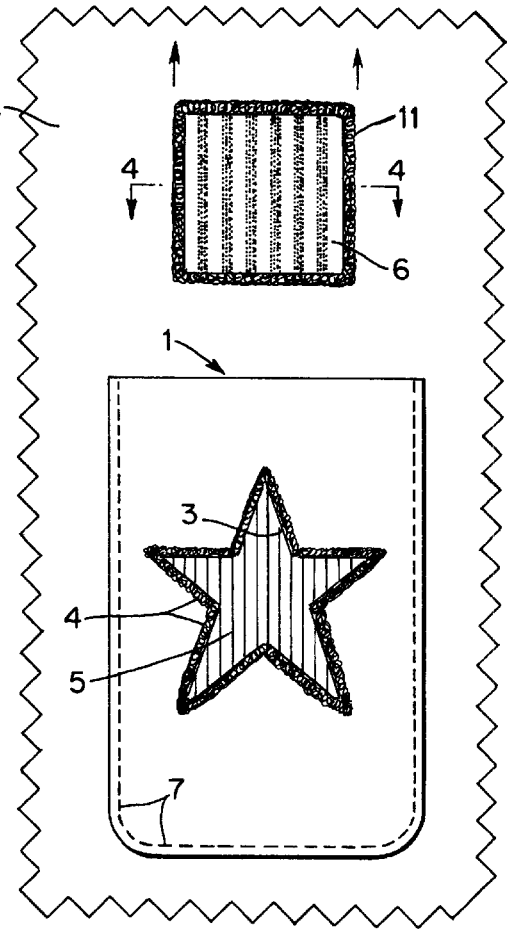

A typical embodiment of the pocket assembly of the present invention is illustrated in FIG. 1A (insert installed) and FIG. 1B (insert removed). The pocket assembly has a fashion pocket 1 of clothing material. A layer of fusible bond 2 (FIGS. 2 and 3) is installed on the entirety of one side of fashion pocket 1. In the preferred embodiment, the fashion pocket is a fabric material of the same composition as the clothing item to which it is attached. However, the fashion pocket can consist of any fabric material of either natural, synthetic or a natural synthetic blend. This material may be cotton, polyester, rayon, etc., which is utilized in the textile industry for clothing. The fusible bond is a commercially available fabric which is fused to the fashion pocket by machinery which intertwines the fabric of the two pieces. After fusing, fashion pocket 1 and fusible bond 2 are handled as one piece.

Figure 2:
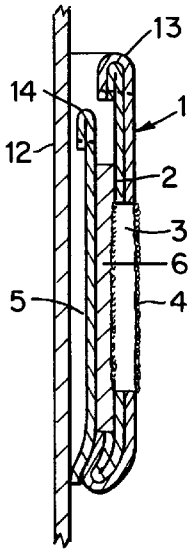
FIG. 2 shows a side view of a pocket assembly.
Figure 3:
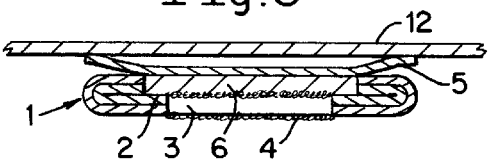
FIG. 3 shows a cross-sectional view of a pocket assembly.

A perimeter pattern of embroidery 4 is sewn on the combined fashion pocket and fusible bond. Any perimeter pattern of embroidery may be used. In FIGS. 1A and 1B a star pattern is used as an example. The width of the embroidery shall be no less than 0.0625 inches. Window opening 3 is formed by removing the fashion pocket and fusible bond material that forms the inside area of the embroidered perimeter. The edge of fashion pocket 1 deemed to be the top edge shall be folded down to meet a line that runs from one side of the fashion pocket to the other side that is horizontally 0.5 inches below the top edge of the fashion pocket. This fold creates fashion pocket finished top 13 as shown in FIG. 2. Fashion pocket finished top 13 shall be secured with fashion pocket finished top stitching 15 along a line that is from 0.20 to 0.24 inches below the fashion pocket finished top as shown in FIG. 1A. The side (2) and bottom edges of fashion pocket 1 shall be folded for attachment preparation as shown in FIGS. 2 and 3.

The pocket assembly has a functional pocket 5 (FIGS. 1B and 2 ) of clothing material. The functional pocket can consist of any fabric material of either natural, synthetic or a natural synthetic blend. This material may be cotton, polyester, rayon, etc., which is utilized in the textile industry for clothing. The edge of functional pocket 5 deemed to be the top edge shall be folded down to meet a line that runs from one side of the functional pocket to the other side that is horizontally 0.5 inches below the top edge of the functional pocket. This fold creates functional pocket finished top 14 as shown in FIG. 2. Functional pocket finished top 14 shall be secured with functional pocket finished top stitching 16 along a line that is from 0.20 to 0.24 inches below the functional pocket finished top as shown in FIG. 1A. The functional pocket shall be aligned to fashion pocket 1 as shown in FIGS. 2 and 3. A line of attachment stitching 7 secures fashion pocket 1 and functional pocket 5 to clothing item 12 (FIG. 1A). The stitching is applied along the sides and bottom of fashion pocket 1 and functional pocket 5; thereby leaving an opening at the top which forms each pocket.

Figure 4:
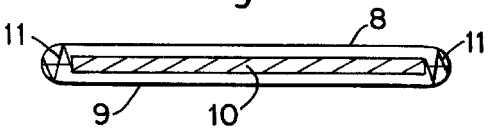
FIG. 4 shows a cross-sectional view of an insert.

The pocket assembly has an insert 6 of various materials. The insert has a side 18 and side 29 (FIG. 4). The side 1 and side 2 can consist of any fabric material of either natural, synthetic or a natural synthetic blend. This material may be cotton, polyester, rayon, etc., which is utilized in the textile industry for clothing. The insert also has a stiffener 10 (FIG. 4) between the side 1 and side 2. The stiffener may consist of fabric material such as that used in stiff shirt collars or flexible plastic such as commercially available "Foam X" used in the bill of baseball hats. The insert is assembled by aligning insert materials 8, 9 and 10 as shown in FIG. 4 and securing them together with assembly stitching 11. Assembly is accomplished using a surge machine to cut the insert to the desired dimensions while stitching 11 is being applied. The insert dimension shall be such that; it can be installed between fashion pocket 1 and functional pocket 5, it does not protrude above fashion pocket finished top 13 and it must fully extend both horizontally and vertically across window opening 3 (FIGS. 1A, 2 and 3).

From the description above, a number of advantages of my fashion pocket assembly become evident:

(a) All components are common commercially available materials currently in use on activewear.

(b) The pocket assembly introduces no use limitations or cleaning maintenance requirements beyond those required for the clothing item to which it is attached.

(c) The use of multiple pocket assemblies with their embroidery and reversible inserts adds fashion to the clothing item.

(d) The use of embroidery provides one hundred percent sealing of the window openings for pocket assembly durability.

(e) Capabilities of computerized embroidery machines allow for successfully using numerous window opening shapes.

(f) Clothing items with the pocket assemblies can be worn more often and still appear different because of numerous fabric patterns available from which to make inserts.

(g) More frequent use of an article of clothing provides greater dollar value for the purchaser.

(h) Appearance changes can be made quickly without having to remove the clothing item (i) The object retention capabilities of conventional pockets is maintained.

(j) Using a functional pocket of a different fabric design than the fashion pocket allows the pocket assembly to be used even if the insert is not in place; the functional pocket acts as a permanent insert. when a reversible insert is not installed.

Operation—FIGS. 1, 2

The manner for using the fashion pocket assembly is straightforward. After installation on clothing item 12, fashion and functional pockets 1 and 5 are permanently attached (FIG. 2). This leaves the insert 6 as the key to manipulating the fashion pocket assembly. The insert is installed by placing it through the opening at the top of the fashion pocket so that it rests between the fashion and functional pockets. In this placement, insert side 18 is visible through window opening 3 providing a design on the clothing item 12 for fashion coordination (FIGS. 1 and 2). To alter the appearance of the clothing item, the insert is removed, rotated and reinserted so that insert side 29 is visible through the window opening providing yet another design for fashion coordination. Functional pocket 5 is installed nearside of the clothing item (FIG. 2) so that it can retain objects between itself and the article of clothing item. Objects are inserted and removed through the opening at the top of the functional pocket. The functional pocket is also visible through window opening 3 when insert 6 is not installed (FIG. 1B).

SUMMARY, RAMIFICATIONS, AND SCOPE

Accordingly, the reader will see that the fashion pocket assembly can be used as a fashion enhancement to articles of clothing. The pocket assembly allows the user to have an interactive role in fashion designing and extends the use of the article of clothing. In addition, consumers receive a better dollar value for their purchase because of increased frequency of wear due to the ability to alter "the look" of the clothing. Furthermore, the pocket assembly has additional advantages in that It uses a lightweight reversible insert which quickly alters the appearance of clothing while the garment is still being worn.

Using multiple pocket assemblies on an item of clothing increases fashion coordination possibilities and the interactive input of the user.

Its use of embroidery is a fashion enhancement that allows one hundred percent sealing of window openings of many shapes and the use of contrasting colors of embroidery introduces another opportunity for fashion coordination.

It is designed to be durable and is suited for often worn casual activewear.

It introduces no additional cleaning care.

It maintains the object retention capabilities of conventional pockets by incorporating a functional pocket.

It uses a functional pocket of a different design from the fashion pocket so that the clothing item appears normal even if the insert is not installed Although the description above contains many specificities, these should not be construed as limiting the scope of the invention but as merely providing illustrations of some of the presently preferred embodiments of this invention. For example, the pocket assembly can have other shapes, such as have a rounded or pointed bottom, etc.; the construction materials may be of any commercially available fabrics; the window openings may be of any shape made by embroidery equipment etc.

Thus the scope of the invention should be determined by the appended claims and their legal equivalents rather than by the examples given.

I claim:

1. A pocket assembly for selectively altering the appearance of a clothing item, comprising:

a. a piece of fabric of sufficient area forming a fashion pocket having a window opening with an embroidered perimeter located approximately in the center of said fashion pocket;

b. a reversible insert viewable through said window opening of fabric having a front side and a back side of different designs and an enclosed stiffener and which is dimensioned so as not to protrude above a top opening of said fashion pocket;

c. a piece of fabric of sufficient area to form a functional pocket for retaining a plurality of objects which is dimensioned so as not to protrude above said fashion pocket top opening; said functional pocket is of a lesser height than that of the fashion pocket;

d. means for attaching said fashion pocket and said functional pocket to said clothing item whereby said reversible insert can be retained between the fashion pocket and functional pocket and have one of said front side and said back side viewable through said window opening and whereby said plurality of objects can be retained between said functional pocket and said clothing item; and whereby the appearance of said clothing item can readily be changed providing more frequent use of said clothing item without introducing use limitations or maintenance concerns beyond those inherent in the attached clothing item while maintaining the object retention capability of conventional pockets.

2. A pocket assembly of claim 1, wherein said fashion pocket further has an attached fabric stiffener.

3. A pocket assembly of claim 1, wherein said fashion pocket with said stiffener material attached thereto has said window opening of any shape as can be formed from embroidery application machinery.

4. A pocket assembly of claim 1, wherein said embroidered perimeter is applied in a dense overlapping fashion as a means of forming a one hundred percent seal of said window opening.

5. A pocket assembly of claim 1, wherein said fashion pocket and said functional pocket have sides and bottoms attached to said clothing item leaving said fashion pocket top opening between said fashion pocket and said functional pocket and a top opening between said functional pocket and said clothing item.

6. A pocket assembly of claim 1, wherein said reversible insert is dimensioned to entirely fill said window opening when the insert is installed and said functional pocket is dimensioned to entirely fill said window opening when the insert is removed.

7. A pocket assembly of claim 1, wherein said reversible insert may be removed from between said fashion pocket and said functional pocket, reversed and reinstalled with said back side visible through said window opening.

* * * * *